United States Patent [19]

Brandenburg et al.

[11] 4,226,545

[45] Oct. 7, 1980

[54] ELECTROMAGNETIC DRIVE FOR RECORDING PINS IN A MATRIX PRINTER

[75] Inventors: Klaus Brandenburg, Kirchen-Wehbach; Hermann Richter; Wendelin Weber, both of Siegen, all of Fed. Rep. of Germany

[73] Assignee: U.S. Philips Corporation, New York, N.Y.

[21] Appl. No.: 951,226

[22] Filed: Oct. 13, 1978

[30] Foreign Application Priority Data

Oct. 15, 1977 [DE] Fed. Rep. of Germany ..... 2746601

[51] Int. Cl.[3] ..... B41J 3/10

[52] U.S. Cl. ..... 400/124; 101/93.05

[58] Field of Search ..... 400/124; 101/93.05; 335/261, 266; 403/297, 371, 372

[56] References Cited

U.S. PATENT DOCUMENTS

| | | | |
|---|---|---|---|
| 4,044,878 | 8/1977 | Kunath | 101/93.05 X |
| 4,051,940 | 10/1977 | Kuelzer | 400/124 |

FOREIGN PATENT DOCUMENTS

| | | | |
|---|---|---|---|
| 2352698 | 5/1974 | Fed. Rep. of Germany | 400/124 |
| 2612585 | 9/1977 | Fed. Rep. of Germany | 400/124 |

*Primary Examiner*—Paul T. Sewell

*Attorney, Agent, or Firm*—Robert S. Smith

[57] ABSTRACT

An electromagnetic drive for a recording pin of a matrix printer, comprising a cylindrical armature which is displaceable by means of an excitation coil and in which a clamping sleeve is provided which comprises an indentation which encloses the recording pin in a clamping manner and whose length governs the position of the recording pin.

2 Claims, 4 Drawing Figures

ELECTROMAGNETIC DRIVE FOR RECORDING PINS IN A MATRIX PRINTER

The invention relates to an electromagnetic drive for recording pin in a matrix printer, comprising a cylindrical excitation coil which is arranged on a yoke and inside of which a cylindrical armature is displaceable, a recording pin being connected to said armature by means of a clamping sleeve which is biassed against the inner wall of the armature.

In a known electromagnetic drive (German Pat. No. 2,439,098) a solid cylindrical armature is provided with a bore in which one end of a recording pin projects. This end of the recording pin is centrally anchored in the bore according to the longitudinal direction of the cylindrical armature by means of a horseshoe-shaped clamping sleeve which is biased against the inner wall of the bore. A drawback of the known electromagnetic drive not only consists in that a substantially solid armature with a bore is comparatively heavy, but also in that the recording pin should in principle extend along to the longitudinal axis of the armature. The latter fact renders the electromagnetic drive unsuitable for use in the matrix printers comprising excitation coils which are coaxially arranged in end abutting relationship and each of which comprises its own armature and recording pin.

Also known is an electromagnetic drive (German patent application No. 2,527,186) which comprises a plurality of excitation coils which are coaxially arranged one in the prolongation of the other and inside of which hollow cylindrical armatures are displaceable in which the recording pin is secured by means of transverse arms of different dimensions. It is thus achieved that the recording pins can extend in parallel over their entire length. The transverse arms are secured to the armature as well as to the recording pin by soldering. Such a double soldered connection is difficult to control during manufacture and imposes a restriction as regards the choice of the materials of the armature, the transverse arm and the recording pin. Even though the transverse arm is also occasionally constructed to comprise a part which encloses the recording pin in a clamping manner, the connection to the armature must still be a soldered connection, so that also in that case the choice of the material of the armature is greatly restricted. Many of the magnetically conductive materials available for the armature are not very well suitable for soldering. Moreover, the mounting of the transverse arms in the armatures is not simple.

The invention has for its object to provide an electromagnetic drive in which the recording pin can be secured along a line parallel to the longitudinal axis of the armature, while at the same end a comparatively wide choice exists as regards the material which can be used for the armature, the clamping sleeve and the recording pin and, moreover, the clamping sleeve can be comparatively simply connected to the armature.

To this end, an electromagnetic drive in accordance with the invention is characterized in that the clamping sleeve comprises an indentation which is directed towards the center of the cylindrical armature and which encloses the recording pin in a clamping manner.

A preferred embodiment of an electromagnetic drive in accordance with the invention, comprising three excitation coils which are coaxially arranged one in the prolongation of the other, will be described in detail hereinafter with reference to the accompanying diagrammatic drawing.

Figure 3:
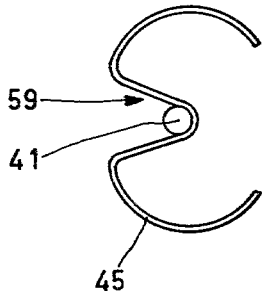

FIG. 3 diagrammatically illustrates an intermediate phase during the connection of a recording pin to a clamping sleeve.

Figure 4:
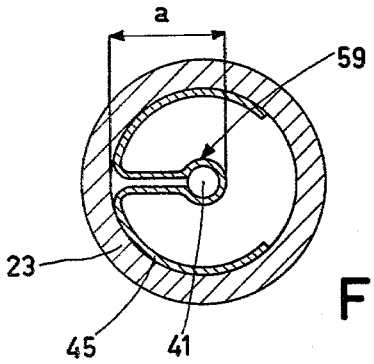

FIG. 4 diagrammatically illustrates the final phase of the connection shown in FIG. 3.

Figure 1:
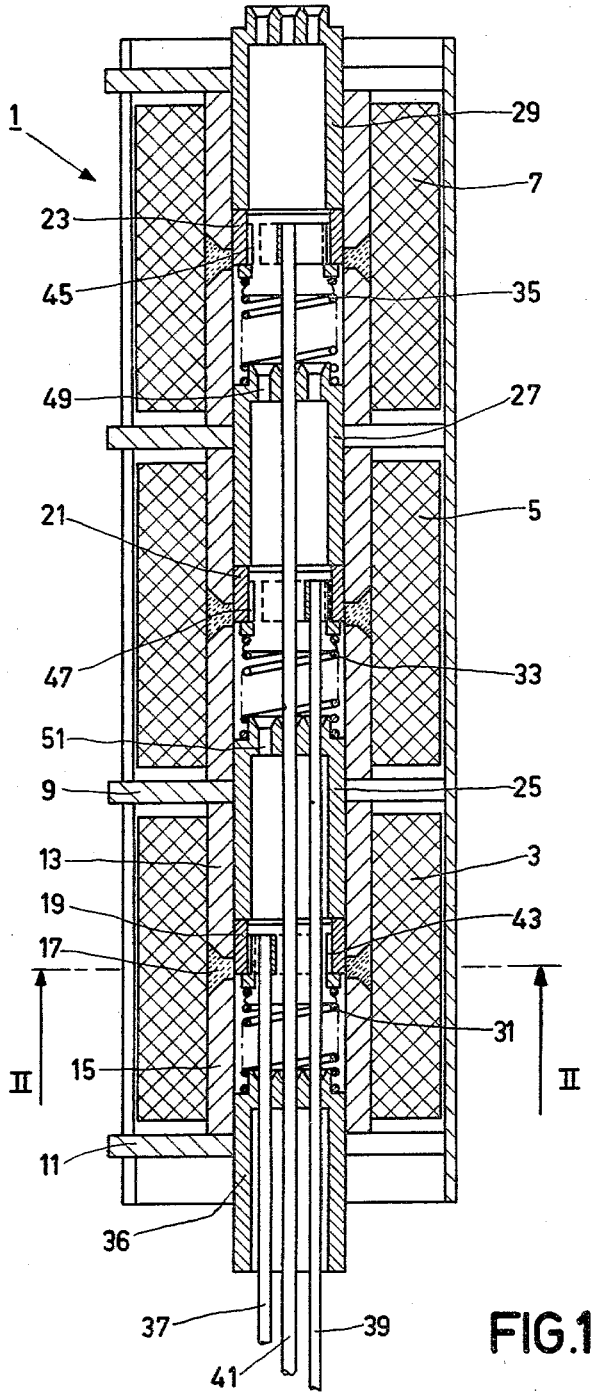
FIG. 1 is a longitudinal sectional view of an electromagnetic drive comprising three excitation coils which are coaxially arranged one in the prolongation of the other.

The electromagnetic drive 1 shown in FIG. 1 comprises three cylindrical excitation coils 3, 5 and 7 which are coaxially arranged in end abutting relationship and which are accommodated on a yoke. The yoke of the excitation coil 3 comprises two transverse plates 9 and 11 of a magnetically conductive material which extend parallel to each other, two hollow cylinders 13 and 15 of a magnetically conductive material which are situated one in the prolongation of the other being arranged therebetween. The cylinders 13 and 15 are magnetically isolated from each other by a ring 17 of an electrically conductive and magnetically insulating material. The construction of the yokes of the excitation coils 5 and 7 is identical to that of the yoke of the excitation coil 3. Inside the excitation coils 3, 5 and 7 hollow cylindrical armatures 19, 21 and 23, respectively, of a magnetically conductive material are arranged to be displaceable. The outer diameters of the armatures 19, 21 and 23 are slightly smaller than the inner diameters of the relevant hollow cylinders forming part of the relevant yoke. The electromagnetic drive 1 furthermore comprises three cylindrical abutments 25, 27 and 29 for the armatures 19, 21 and 23, respectively. Between the armatures 19, 21 and 23 and the abutments 25, 27 and 29 there are provided helical springs 31, 33 and 35, respectively, one end of which is lightly biased against the relevant armature, whilst their other end is biased against the relevant abutment. The helical spring 31 bears against an abutment 36. The armatures 19, 21 and 23 are shown in their neutral position in FIG. 1 (excitation coils not excited), the relevant rings (see the ring 17) not being bridged by the armatures. Recording pins 37, 39 and 41 are connected to the armatures 19, 21 and 23, respectively, by means of clamping sleeves 43, 45 and 47. The abutments 27, 25 and 36 comprise apertures such as, for example, the apertures 49 and 51 for the passage of the recording pins of different length.

Figure 2:
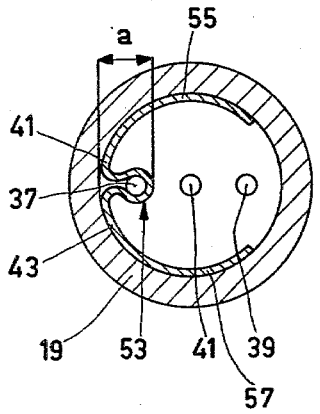
FIG. 2 is a diagrammatic sectional view taken along the line II—II in FIG. 1.

The armatures 19, 21 and 23 are in principle connected to the relevant recording pins 37, 39 and 41 in the same manner. The connection of an armature to a recording pin will be described with reference to FIG. 2 which illustrates the connection of the armature 19 to the recording pin 37.

The recording pin 37 is clamped in an indentation 53 which is directed radially inwards towards the center of the armature 19. The distance a between the inner wall of the armature 19 and the extreme outer edge of the indentation 53 governs the position of the recording pin 37 and can be adjusted during the manufacture of the clamping sleeve 23 so that the position of the recording pin is accurately defined after the introduction of the clamping sleeve into the armature. The clamping sleeve 43 is then biased, by way of the parts 55 and 57, against the inner wall of the armature 19. The distance a which indicates the dimension of the indentations of the clamping sleeves intended for different recording pins is obtained on the basis of a sleeve which is split parallel to its longitudinal axis, like the sleeve 45 shown in the FIGS. 3 and 4 which is intended for the armature 23 and the recording pin 41. In this sleeve 45 an axially directed, initially V-shaped indentation 59 is impressed which is flattened after insertion of the recording pin 41 in the indentation. As appears from FIG. 4, the indentation is preferably slightly deformed around the recording pin 41 in order to achieve a suitable clamping action. After the recording pin has been clamped, the clamping sleeve 45 is somewhat compressed prior to being slid into the armature 23. As soon as the clamping sleeve 45 approaches the correct axial position with respect to the armature, the clamping sleeve which is held in a tool is released, so that it can relax and is biased against the inner wall of the armature 23. The clamping sleeve 45 is then slid into its ultimate position against the friction between the clamping sleeve ans the armature. In electromagnetic drives comprising excitation coils which are coaxially arranged one in the prolongation of the other, the clamping sleeve offers adequate space for the passage of recording pins other than the relevant recording pin. This is demonstrated in FIG. 2 with reference to the recording pins 39 and 41. The clamping sleeves are preferably made of a spring material such as, for example, spring steel. Depending on the required clamping force, a clamping sleeve of long or short length can be used. The length of the clamping sleeve, however, is preferably chosen so that it does not exceed the length of the armature. In cases where comparatively high impact forces of the recording pins are required, a soldered connection can be provided between the clamping sleeve and the armature. As has already been stated, however, the choice of materials for the armature and the clamping sleeve is then limited. The advantage of the comparatively simple mounting is maintained, of course.

The described electromagnetic drive can also be used in matrix printers comprising individual electromagnetic drives which are arranged in a fan-shaped manner. In that case, the flexible recording pins are not straight over their full length and do not extend parallel to each other. The clamping of the recording pin is then in accordance with the longitudinal axis of the armature, for example, as shown in FIG. 4. The electromagnetic drive can also be used in matrix printers comprising adjacently arranged individual drives where the recording pins are straight and extend parallel to each other. Electromagnetic drives of this kind may be constructed, for example, like the bottom drive shown in FIG. 1.

What is claimed is:

1. An electromagnetic drive for a recording pin in a matrix printer, comprising a cylindrical excitation coil which is arranged on a yoke and inside of which a cylindrical armature is displaceable, a recording pin being connected to said armature by means of a clamping sleeve which includes means for biasing said clamping sleeve against the inner wall of the armature and which encloses the recording pin in a clamping manner, said clamping sleeve comprises an indentation which extends radially towards the center of said cylindrical armature and which encloses the recording pin in a clamping manner said indentation being spaced from said means for biasing.

2. An electromagnetic drive comprising at least two cylindrical excitation coils as claimed in claim 1, said excitation coils being substantially coaxially disposed in substantially end abutting relationship at least one recording pin which is connected to a given armature extending through the clamping sleeve of at least one other armature.

* * * * *